US008885862B2

(12) United States Patent
Rossing et al.

(10) Patent No.: US 8,885,862 B2
(45) Date of Patent: Nov. 11, 2014

(54) DISPLAY WITH WAVE GENERATORS

(75) Inventors: David P Rossing, Poway, CA (US); Xiaoqi Zhou, San Diego, CA (US); Steve Ledak, Santee, CA (US); Paul C Landrum, San Diego, CA (US); Tuo Wu, Fallbrook, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 131 days.

(21) Appl. No.: 13/596,633

(22) Filed: Aug. 28, 2012

(65) Prior Publication Data

US 2014/0064515 A1 Mar. 6, 2014

(51) Int. Cl.
*H04R 1/02* (2006.01)
*H04R 9/06* (2006.01)

(52) U.S. Cl.
USPC ..... 381/333; 381/87; 381/388

(58) Field of Classification Search
USPC ..... 381/190, 332–334, 388, 424–426, 428, 381/431
See application file for complete search history.

(56) References Cited

U.S. PATENT DOCUMENTS

| | | | | |
|---|---|---|---|---|
| 5,504,836 | A * | 4/1996 | Loudermilk | 704/272 |
| 5,513,455 | A * | 5/1996 | Walker | 40/788 |
| 6,956,492 | B2 | 10/2005 | Beadman et al. | |
| 7,245,729 | B2 | 7/2007 | Bank et al. | |
| 2006/0159293 | A1 * | 7/2006 | Azima et al. | 381/152 |
| 2011/0016759 | A1 * | 1/2011 | Ramos-Gonzalez et al. | 40/773 |

FOREIGN PATENT DOCUMENTS

DE 202008012402 11/2008

OTHER PUBLICATIONS

"Dayton Audio DAEX25 Sound Exciter Pair"; http://www.parts-express.com/pe/showdet1.cfm?Partnumber=300-375 &FTR=dayton%20audio%20daex25%20sound%20exciter%20pair; 6 pages, retrieved on Jun. 18, 2012.
partsexpressdotcom; "Dayton Sound Exciters,Tactile Transducers, Product Review"; 1 page; http://www.youtube.com/watch?v=N0wZ0qWH3sY; Aug. 5, 2010.
Ruiz, E.; "SoundPax NXT loudspeaker"; http://audio-nirvana.fortunecity.net/pag_eng/soundpaxg.htm; Sep. 23, 2002; 4 pages.

* cited by examiner

*Primary Examiner* — Matthew Eason
(74) *Attorney, Agent, or Firm* — Garry A. Perry

(57) ABSTRACT

In one embodiment, a kit for making a display includes a first medium, a support element, and first and second wave generators. The first medium is foldable according to scoring to form a display with a cavity. The element is attachable or attached to a back surface of the folded first medium, to be positioned at least partially within the cavity. The first wave generator is attachable or attached to the back surface, to receive signals from a signal generator and produce mechanical waves that cause the first medium to vibrate and generate audible acoustic waves within a first frequency range. The second wave generator is attachable or attached to the element, to receive signals from the signal generator and produce mechanical waves that cause the element to vibrate and generate audible acoustic waves within a second frequency range, different from the first frequency range.

18 Claims, 6 Drawing Sheets

DISPLAY WITH WAVE GENERATORS

BACKGROUND

Advances in digital image printing technologies, such as inkjet printing and laser printing, have expanded personal printer use beyond conventional uses such as the creation of reading materials, reports, worksheets, and photographs, etc. Today, users of personal printers can create print upon satin, canvas, and other fine art grade mediums to create museum-quality display prints to be displayed as home or office décor.

BRIEF DESCRIPTION OF THE DRAWINGS

The accompanying drawings illustrate various embodiments and are a part of the specification. The illustrated embodiments are examples and do not limit the scope of the claims. Throughout the drawings, identical reference numbers designate similar, but not necessarily identical elements.

FIGS. 23 and 2C provide views of support elements with score lines to guide cutting, according to various embodiments.

The same part numbers designate the same or similar parts throughout the figures.

DETAILED DESCRIPTION OF EMBODIMENTS

Figure 1:
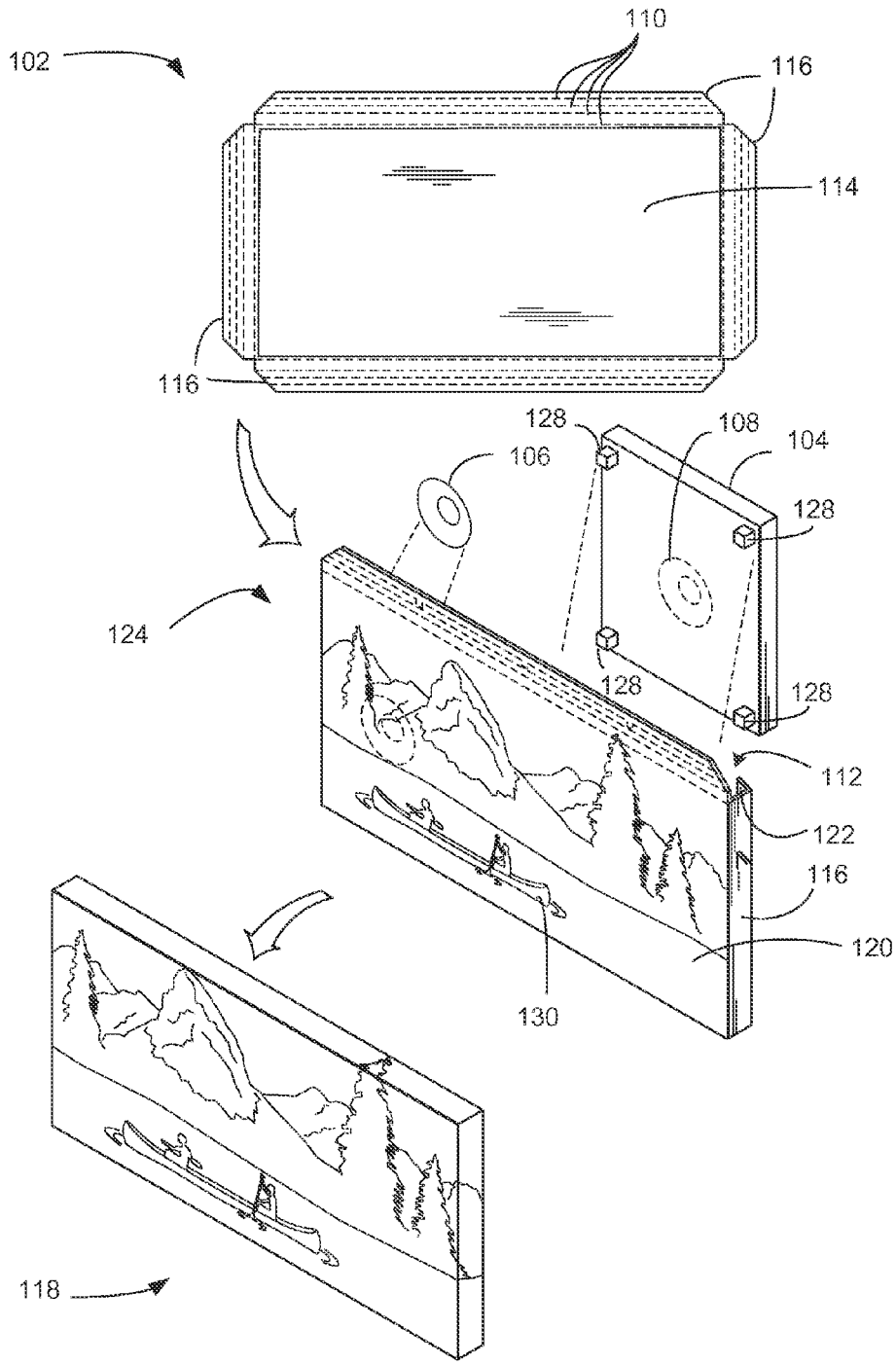
FIG. 1 provides views of a kit to form a display with a foldable first medium, a support element to be secured to the folded first medium, first and second wave generators, and an assembled display according to various embodiments.

Traditional radios, stereo systems, entertainment systems, and other sound systems available to consumers today are typically generic in appearance and thus may be deemed by users as unattractive for a home or office. Such audio devices are often box-like and metallic in appearance and are thus quite noticeable in a household or office in comparison with other room accessories. For these reasons, users are will appreciate an inexpensive, aesthetically pleasing audio device that provides a good sound quality and complement household and office décor.

Accordingly, various embodiments described herein were developed to provide an acoustic display with multiple wave generators strategically arranged to cause the generation of high quality audible acoustic waves, and a kit for assembling the display. The display, in addition to serving as a generator of acoustic waves for listening pleasure, also functions as a standalone household decoration or as a hanging wall decor.

An example of the disclosure includes a three dimensional faux canvas personalized display created using a user-selected image printed via a digital printer.

In an example, the display includes a first medium foldable according to score lines or other scoring to form a display with a cavity, the first medium including a front surface and a back surface opposite the front surface. The display additionally includes a support element that is attachable or attached to the back surface of the folded first medium. The support element is to be positioned at least partially within the cavity. The display additionally includes a first wave generator attachable or attached to the back surface of the folded first medium. The first wave generator is to receive signals from a radio, MP3 player, CD player, or other signal generating device and produce mechanical waves within the first medium that cause the first medium to vibrate and generate audible acoustic waves within a first frequency range in accordance with the signals. The display additionally includes a second mechanical wave generator that is attachable or attached to the support element, the second wave generator to receive signals from the signal generator and produce mechanical waves within the support element that cause the support element to vibrate and generate audible acoustic waves within a second frequency range, different from the first frequency range, in accordance with the signals.

Advantages of the disclosure include that a user can create an inexpensive, personalized artwork that performs the functions of one or more sound-producing devices, thereby improving the aesthetics of the sound-producing devices in the home. Because of the placement of the first and second mechanical wave generators upon different elements of the display (e.g., one upon the first medium and one upon the support element), the sound is generated in different frequency ranges and is therefore covers a broader frequency range than would be the case for a display in which the sound generators are attached to a same surface. As the sound-producing device will have good acoustics and is also an aesthetically pleasing or comforting artwork, user satisfaction with printing and with audio devices will be increased.

As used in this application, a "digital printer" or "digital printing device" refers to any electronic device that prints a digital based image onto a media. Examples of digital printers include inkjet printers, piezoelectric printers, electrophotographic printers, liquid electrophotographic printers, and solid ink dye-sublimation printers. A "digital printer" or "digital printing device" includes any multifunctional electronic device that performs a function such as scanning and/or copying in addition to printing. A "mechanical wave" refers to any wave that travels through a medium to cause vibration of the medium. A mechanical wave may be in the form of a transverse wave, a longitudinal wave, a surface wave, or a bending wave. A "tab" refers to a projection from or appendage to a medium.

FIG. 1 provides views of a kit to form an acoustic display according to various embodiments. The kit of FIG. 1 includes a foldable first medium 102, a support element 104 to be secured to the folded first medium 102, a first wave generator 106, and a second wave generator 108. In an example, the first medium 102 may be a first medium that includes score lines 110 and is foldable according to the score lines 110 or other scoring to form a cavity 112. In certain embodiments, the folding of the first medium 102 is such that the cavity 112 is formed in the shape of a concave. In an example, the first medium 102 may be a cellulose product, such as a cellulose card stock, corrugated fiberboard or other paperboard. In other examples, the first medium 102 may be made of any lightweight foldable material, including, but not limited to a pure element such as an aluminum foil, a compound of multiple elements such as a copper-zinc ahoy foil, a synthetic polymer such a polypropylene, or a composite such as PET/$CaCO_3$ coextruded sheet. In an example, the first medium 102 included within the kit includes a printed or painted image 130 on the front surface 120 to enhance the appearance of the acoustic display and render the display appropriate as a standalone household decoration or a wall decoration.

Continuing with the example kit of FIG. 1, the first medium 102 includes a center portion 114 and four extensions 116 connected to the center portion 114, with each extension 116 to be folded four times according to the score lines 110 on the extension 116 to form an assembled rectangular polygon display 118. In other examples, the first medium is configured to, when folded, form a frame or support for a display that is other than a rectangular polygon (e.g., a triangle, or an oval). In a certain example, each extension 116 may be folded three times upon itself to form a frame or support for the display. In other examples, each extension may in a form to be folded more than four times upon itself.

The support element 104 is to be directly or indirectly attached to the first medium 102 to afford the benefit of making the assembled display 118 more sturdy and/or allowing for a larger display than would be possible without the support element 104. The support element 104 also provides a benefit of enhancing the sound quality of the finished acoustic display 118. In examples, the support element 104 may be a cellulose product, such as a cellulose card stock, corrugated fiberboard or other paperboard. In other examples, the support element 104 may be made of any lightweight foldable material, including, but not limited to a pure element such as an aluminum foil, a compound of multiple elements such as a copper-zinc alloy foil, a synthetic polymer such a polypropylene, or a composite such as PET/$CaCO_3$ coextruded sheet. In an example, the support element 104 and the foldable first medium 102 are made of a same cellulose material.

Figure 2A:
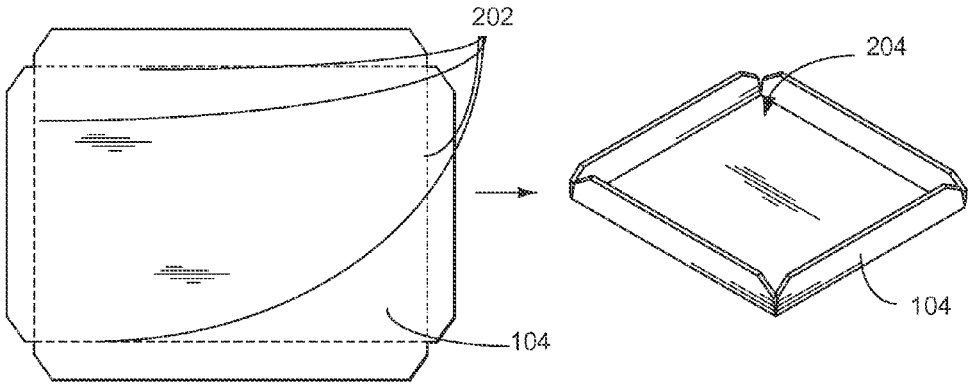
FIG. 2A provides a view of a support element, according to various embodiments.
Figure 2B:
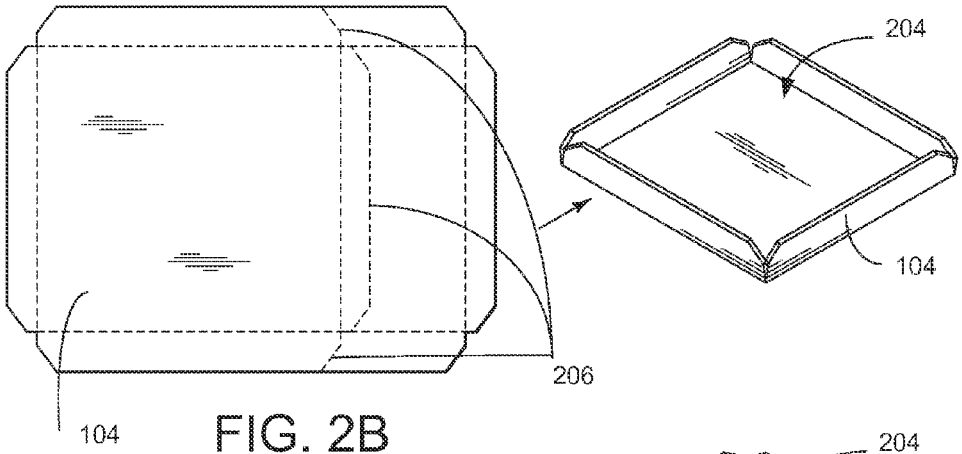
Figure 2C:
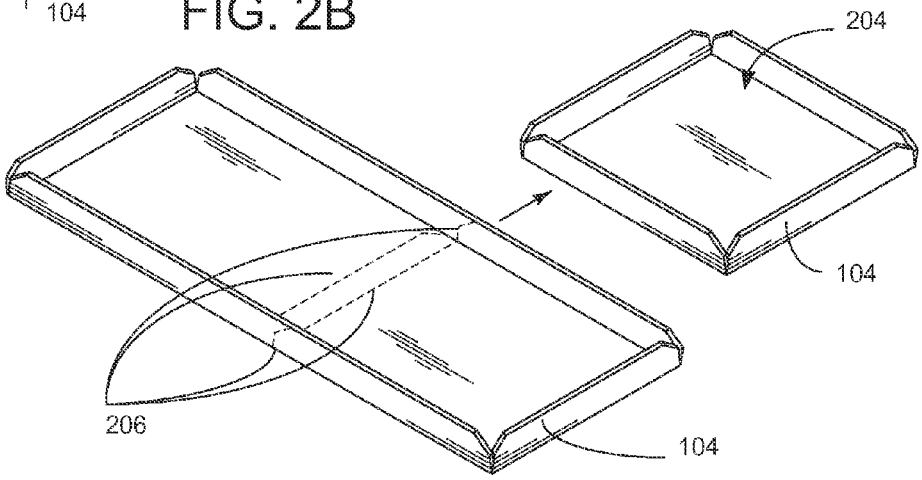

Moving to FIG. 2A, in an example the support element 104 included within the kit has score lines 202 and is foldable according to the score lines 202 or other scoring to form a cavity 204. In certain embodiments, the folding of the support element 104 is such that the cavity 204 is formed in the shape of a concave. Moving to FIGS. 2B and 2C, in examples the support element 104 included within the kit has score lines 206 to guide a user to cut or shape the support element to dimensions such that the support element 104 and a first wave generator 106 can each be attached to the back surface 122 of the folded first medium 102 without the support element 104 being in contact with the first wave generator 106.

Returning to FIG. 1, the kit may also include one or more spacer elements 128 that are securable or secured to the back surface 122 of the first medium 102 to position the support element 104 to not touch the center portion 114 of the first medium 102. Use of spacer elements 128 can reduce interference with the mechanical waves or the acoustic waves. In some situations, if a support element 104 is installed to form the display 118 in such a way that the support element is in contact with the center portion 114 of the first medium 102, acoustic interference can result as the support element 104 vibrates and bumps against the center portion 114. The inclusion of the spacer elements 128 mitigates this contact to reduce the acoustic interference and cause the production of a crisper, more accurate replication of the sound in accordance with the signal from the signal generator. The spacer elements 128 can also reduce or eliminate acoustic interference that might result as the center portion 114 vibrates and bumps against the support element 104 as a result of mechanical waves created by the first wave generator 106. In this example, the inclusion of the spacer elements 128 can mitigate or remove the contact between the support element 104 and the vibrating center portion 114, resulting in better sound quality. In examples, the spacer elements 128 include a plastic, polyurethane, foam, or other lightweight material. In one example, the kit includes one or more spacer elements 128 that are to be installed by user between to the back surface 122 of the first medium 102 and the support element 104. In another example kit, the spacer elements 128 are pre-attached either to the center portion 114 of the back surface 122 of the first medium 102, and/or to the support element 104.

Continuing with FIG. 1, an example kit includes a first wave generator 106 that is attachable or attached to the first medium 102 to be at least partially contained within the cavity 112 that is formed when the first medium is folded. The first wave generator 106 is a system or unit to receive signals from a signal generator and produce mechanical waves within the first medium 102 that will cause the first medium 102 to vibrate and generate audible acoustic waves within a first frequency range in accordance with the signals.

In an example kit, the first wave generator 106 is separate from the first medium, is to be attached to the back surface 122 and positioned within the cavity 112 by a user that is assembling the display 118. In another example kit, the first wave generator 106 is pre-attached to the back surface 122 of the first medium 102 so as to be positioned within the cavity 112 during assembly of the display 118.

The example kit also includes a second wave generator 108 that is attachable or attached to the support element 104 to be at least partially contained within the cavity 112. The second wave generator 108 is a system or unit to receive signals from a signal generator and produce mechanical waves within the support element 104 that will cause the first medium 102 to vibrate and generate audible acoustic waves within a second frequency range, different from the first frequency range, in accordance with the signals.

In the example kit of FIG. 1, the kit and assembled display 118 may include a single first wave generator 106 to be attached to the first medium 102 and a single second wave generator 108 to be attached to the support element 104. In other examples, the kit and assembled display may include multiple wave generators attached to the first medium, and/or multiple wave generators attached to the support element. In examples, the assembled display may include multiple support elements with one or more attached wave generators.

In an example, the kit may include a signal generator to supply the audio signal to the first wave generator 106. For instance, the signal generator may be a radio receiver or MP3 player or other audio device to be included with the cavity 112 of the finished display 118 and cause an audio transmission of songs, speech, or other recorded content that is held in memory within the audio device. In another example, the signal generator may be a radio receiver to be located within the cavity 112 of the finished display 118, the radio receiver to play audio content that is received at the receiver via electromagnetic waves.

Continuing with FIG. 1, the partially-assembled display 124 illustrates the appearance of the foldable first medium 102, support element 104, and the first and second wave generators 106 108 during an example display assembling operation. In an example, the assembly operation includes a step of a user folding foldable first medium 102 at the score lines to form the polygon. In an example, the folding operation includes a step of a user folding a second medium according to score lines to form the support element 104. In an example, the first and second wave generators 106 and 108 are included in the kit as items separate from the first medium 102 and the support element 104, to be attached to the first medium 102 and the support element respectively during the assembly operation. In other examples of kits, the first wave generator 106 may be pre-attached to the back surface 122 of the first medium 102, and/or the second wave generator 108 may be pre-attached to the support element 104. The assembled display 118 of FIG. 1 illustrates a front view of a completed display after folding of the first medium 102, after the attachment of the first wave generator 106 to the first medium 102, after attachment of the second wave generator 108 to the support element 104, and after the attachment of the support element 104 to the first medium 102.

Figure 3:
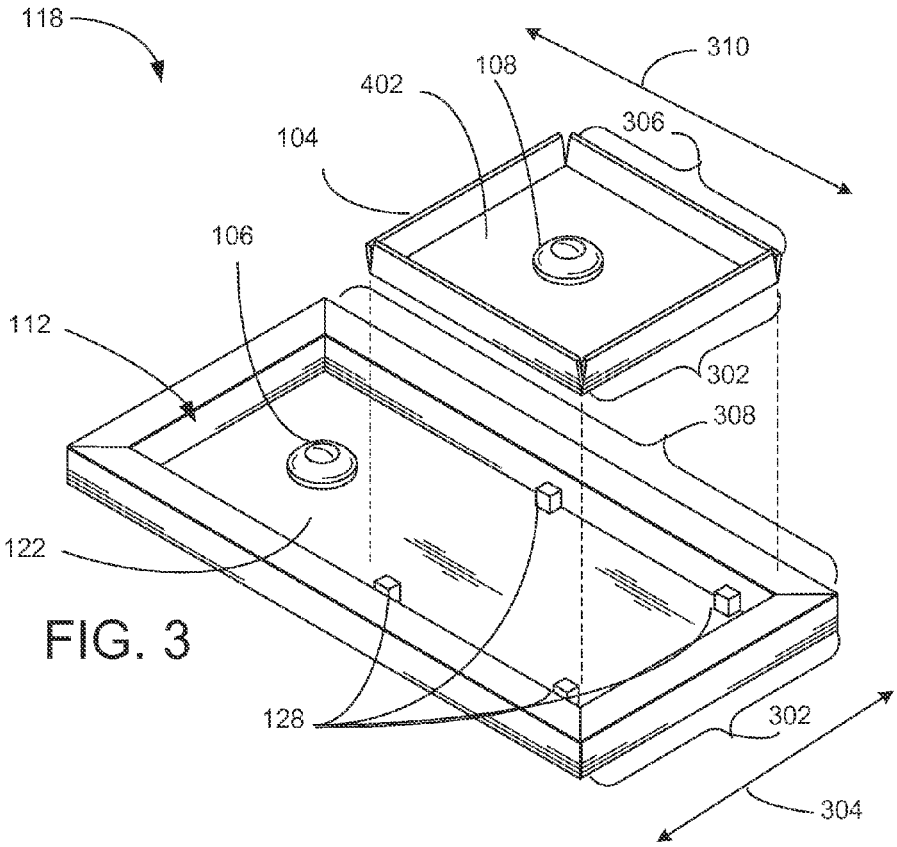
FIG. 3 is a back, perspective, exploded view of the assembled display of FIG. 1, according to various embodiments.
Figure 4:
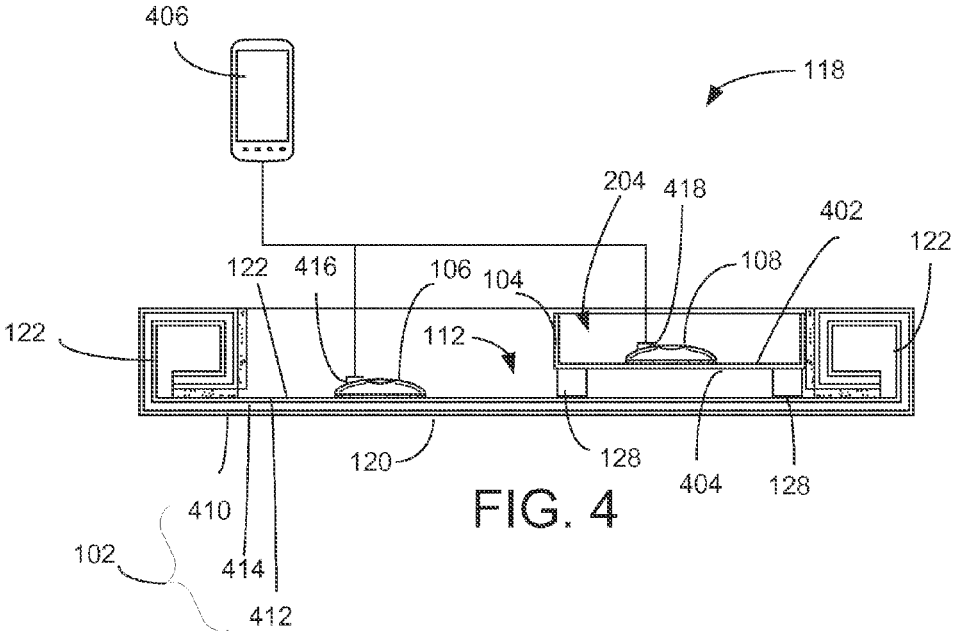
FIG. 4 is a cross-section view of the displays of FIG. 1, according to various embodiments.

FIG. 3 is a back, perspective, exploded view of the assembled rectangular polygon-shaped display 118 of FIG. 1 FIG. 4 is a cross-section view of the assembled display 118 of FIG. 1. FIGS. 3-4 illustrate the foldable first medium 102, support element 104, first and second wave generators 106 108, and cavity 112. In the example kit of FIGS. 1, 3 and 4, the first medium 102 has a first layer 410 and a second layer 412 that are non-corrugated and that include chemical pulped cellulose fibers and low moisture absorbing fibers. In this example, the first medium 102 also has a third layer 414 that is corrugated, includes cellulose fibers and is situated between the first 410 and second 412 non-corrugated layers. In this example, the first 410, second 412 and third 414 layers are adhered to each other by a polymeric adhesive or a chemically treated starch. The support element 104 is indirectly attached to the first medium 102 via spacer elements 128 to afford the benefit of making the assembled display 118 more sturdy and/or allowing for a larger display than would be possible without the support element 104. The support element 104 also provides a benefit of enhancing the sound quality of the finished acoustic display 118.

The display 118 includes multiple spacer elements 128 that are secured to the back surface 122 of the first medium 102 and to the support element 104 to position the support element 104 to not touch the center portion 114 of the first medium 102. Use of the spacer elements 128 can reduce interference with the mechanical waves or the acoustic waves that might otherwise occur if the support element 104 were to touch the center portion 114 of the first medium 102. In example of FIGS. 1 and 3-4, the spacer elements 128 are elements including plastic, polyurethane, foam, or other lightweight material that a user is to position between the first medium 102 and the support element 104.

FIGS. 3 and 4 illustrate the that the display 118 includes a first wave generator 106 attached to the back surface 122 of the first medium 102 and at least partially contained within the cavity 112. The first wave generator 106 is a system or unit to receive signals from a signal generator and produce mechanical waves within the first medium 102 that will cause the first medium 102 to vibrate and generate audible acoustic waves within a first frequency range in accordance with the signals. The example kit also includes a second wave generator 108 that is attached to the support element 104 and at least partially contained within the cavity 112. The second wave generator 108 is a system or unit to receive signals from a signal generator and produce mechanical waves within the support element 104 that will cause the first medium 102 to vibrate and generate audible acoustic waves within a second frequency range in accordance with the signals. In the example of FIGS. 3 and 4, the second wave generator 108 is attached to a first side 402 of the support element 104 that is outward-facing when the display 118 is assembled. In the example of FIG. 3, the first medium 102 and the support element 104 have a substantially same width 302 along a first axis 304, and the support element 104 has a shorter length 306 than the length 308 of the first medium 102 along a second axis 310, and wherein the difference between the length 308 of the first medium 102 and the length 306 of the support element 104 is sufficient for the attachment of the first wave generator 106 to the first medium 102 without being in contact with the support element 104.

In another example, the support element 104 may make for an attractive display by covering or partially covering the second wave generator 108. In this latter example, the second wave generator 108 is attachable to a second side 404 of the support element 104 that faces the back surface 122, i.e. is inward-facing when the display 118 is assembled. In this latter embodiment, a hole may be included or created in the support element 104 to allow a cable or wire lead or leads to pass through the support element 104 and to connect a signal generator 406 to the second wave generator 108 via an interface.

FIG. 4 illustrates a MP3 signal generator 406 to supply audio signals to the first wave generator 106 and the second wave generator. In other examples, the signal generator 406 may be a tablet computer, notebook computer, radio, stereo receiver, or any other audio signal generator. In an example, the signal generator 406 may be a MP3 player or radio receiver or other audio device to be included with the cavity 112 of the finished display 118 and cause an audio transmission of songs, speech, or other recorded content that is held in memory within the audio device. In another example, the signal generator 406 may be a radio receiver to be located within the cavity 112 of the finished display 118, the radio receiver to play audio content that is received at the receiver via electromagnetic waves. In an example, the signal generator 406 is included within a kit for making the acoustic display 118. In another example kit, the signal generator 406 that provides the audio signal is an electronic device that is not included within the kit, but which is attachable to the first wave generator 106 via first and second interfaces 416 418 included within the kit.

The kit and display 118 of FIGS. 1-3 include a first interface 416 to electronically connect the first wave generator to the signal generator; and a second interface 418 to electronically connect the second wave generator to the signal generator 406. In examples, the first and second interfaces 416 418 may be any type of interface or connector or adapter to connect signal generators, components, or apparatuses, including, but not limited to, a cable, cable connectors, interface card, card slot and/or port. In another example, the interfaces 416 418 include a wireless receiver such that the first and second wave generators 106 108 can wirelessly receive signals from the signal generator 406. In an example kit, the first wave generator 106 is electronically connected to the signal generator 406 via the first interface 416, and the second wave generator 108 is electronically connected to the signal generator 406 via the second interface 418. In another example kit, the first and second wave generators 106 108 are unconnected, to be electronically connected, e.g., via the first and second interfaces 416 418, to the signal generator 406 by a user that is assembling the display 118.

Figure 5:
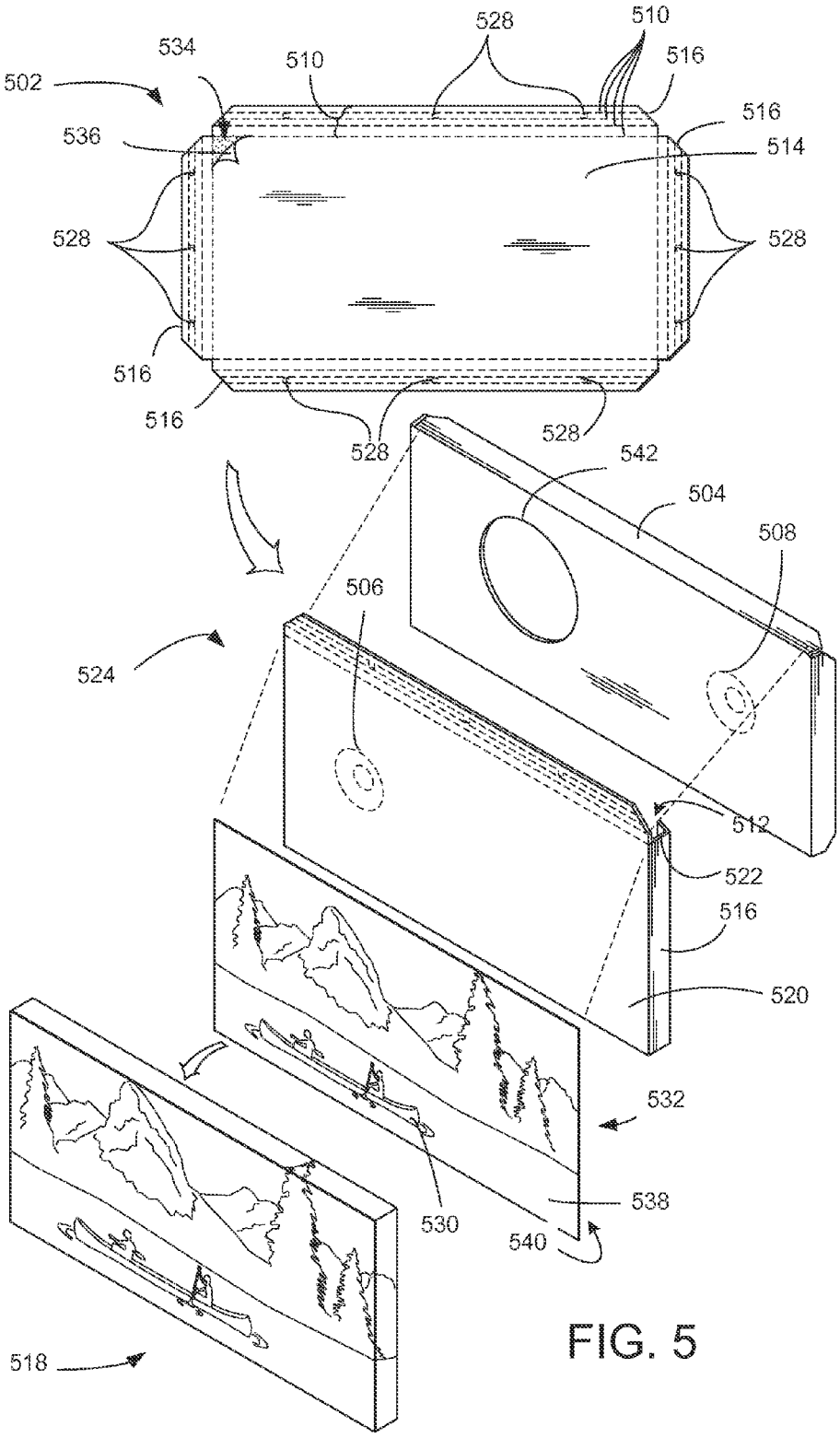
FIG. 5 provides views of a kit to form a personalized display with a foldable first medium, a personalizable second medium, a support element to be secured to the folded first medium, first and second wave generators, and an assembled display according to various embodiments FIG. 6 provides a view of a support element with scoring to guide cutting, according to various embodiments.

FIG. 5 provides views of a kit to form a personalized acoustic display according to various embodiments. The kit of FIG. 5 includes a foldable first medium 502 in the form of a blank, a personalizable second medium 532, a support element 504 to be secured to the folded first medium 502, a first wave generator 506, and a second wave generator 508. In an example, the first medium 502 may be a blank that includes score lines 510 and is foldable according to the score lines 510 to form a cavity 512. In an example, the first medium 502 may be a cellulose product, such as a cellulose card stock, corrugated fiberboard or other paperboard.

Continuing with the example of FIG. 5, the first medium 502 includes a center portion 514 and four extensions 516 connected to the center portion 512, with each extension to be folded four times according to the score lines 510 on the extension 516 to form a rectangular polygon display 518. The first medium 502 includes an adhesion surface 520 and a back surface 522 that is opposite the adhesion surface 520. The adhesion surface 520 is a surface to receive a personalized print medium 532.

In an example, the foldable the first medium 502 additionally includes an adhesive layer 534 established upon the adhesion surface 520. The adhesive layer 534 may be in the form of a glue, resin, or any other sticky material to promote adhesion of a personalized print medium 532 to the adhesion surface 520 of the first medium 502. In an example, the first medium 502 also includes a removable liner 536 positioned on the adhesive layer 534. The removable liner 536 is to keep the adhesive layer 534 from sticking to other kit or display materials, or a user, prior to the adhesive layer's intended use to cause adhesion of a personalized print medium 532 to the first medium's adhesion surface 520.

The personalizable print medium 532 includes a personalization surface 538 to receive a user selected-image, and includes a rear surface 540 opposite the personalization surface 538 to adhere to the blank's adhesion surface 520. The print medium 532 may be in the form of, but is not limited to, a cellulose print medium or a polymeric print medium. In examples, the personalization surface 538 may be a smooth, glossy, shiny surface. In other examples, the personalization surface 538 may be in the form of a satin, matte or other textured surface. In one example, a satin personalization layer includes a matte agent with fillers in the personalization layer, e.g. ground calcium carbonate, clay or organic beads such as polyethylene dispersions. In an example, the matte agent has a large particle size (e.g., from about 20 μm to about 50 μm). In another example, the matte agent is a hollow polymeric particle, wherein from about 20% to 60% of particle volume is occupied by air voids.

The personalization surface 538 is to be personalized with a user-selected image 530 to enhance the appearance of the acoustic display and render the display appropriate as a standalone household decoration or a wall decoration. In examples, the user-selected image 530 is to be printed to the personalization surface using a digital printer. The digital printer used to print the user-selected image may be any type of printing device, including, but not limited to an inkjet printer, a piezoelectric printer, an electrophotographic printer, a liquid electrophotographic printer, or a solid ink dye-sublimation printer. In the example of FIG. 5, the personalization surface 538 of the print medium 532 is shown with a user-selected image 530 of a canoe and lake that has been applied to the personalization surface 538 with a digital printer.

Continuing with the example kit of FIG. 5, the first medium 502 includes a center portion 514 and four extensions 516 connected to the center portion 514, with each extension 516 to be folded times according to the score lines 510 on the extension 516 to form an assembled rectangular polygon display 518.

The support element 504 is to be directly, or indirectly (e.g., via spacer elements), attached to the first medium 502 to afford the benefit of making the assembled display 518 more sturdy and/or allowing for a larger display than would be possible without the support element 504. The support element 504 also provides a benefit of enhancing the sound quality of the finished acoustic display 518. The support element 504 includes a hole 542 with a longest diameter greater than the longest side or diameter of the first wave generator, such that the support element 504 and the first wave generator 506 are attachable to the back surface 522 of the folded first medium 502 with the first wave generator situated in the hole. In this manner the support element 504 is not in contact with the first wave generator 506. In examples, the support element 504 may be a cellulose product, such as a cellulose card stock, corrugated fiberboard or other paperboard. In other examples, the support element 504 may be made of any lightweight foldable material, including, but not limited to a pure element such as an aluminum foil, a compound of multiple elements such as a copper-zinc alloy foil, a synthetic polymer such a polypropylene, or a composite such as PET/$CaCO_3$ coextruded sheet. In an example, the support element 504 and the foldable first medium 502 are made of a same cellulose material.

Figure 6:
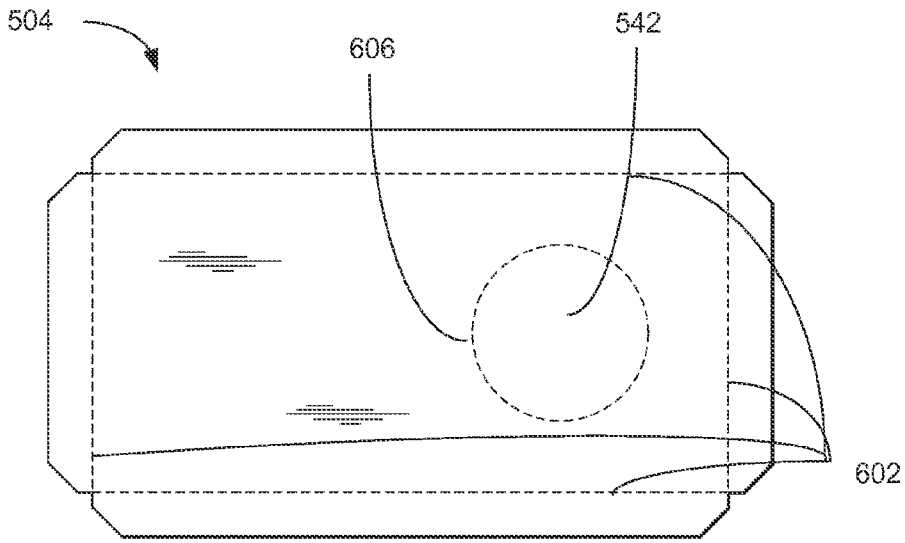
Figure 7:
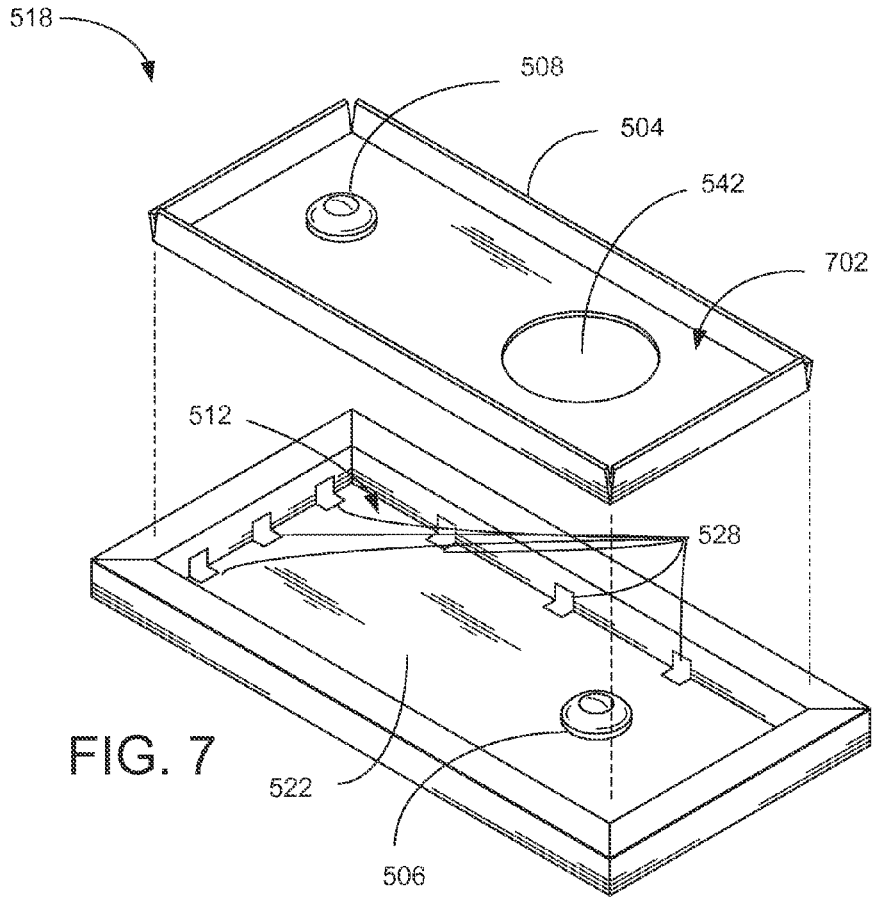
FIG. 7 is a back, perspective, exploded view of the assembled display of FIG. 5, according to various embodiments.
Figure 8:
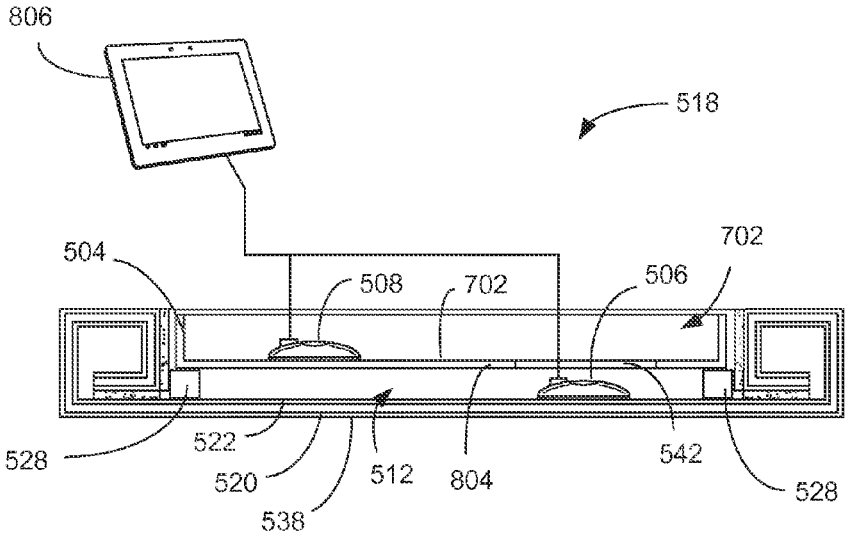
FIG. 8 is a cross-section view of the display of FIG. 5, according to various embodiments.

Moving to FIG. 6, in an example the support element 504 included within the kit has score lines 602 and is foldable according to the score lines 602 to form a cavity 702 (FIGS. 7 and 8). Moving to FIGS. 7 and 8, in examples the support element 504 included within the kit has scoring 606 to guide a user to cut or shape a hole 542 in the support element to dimensions such that the support element 504 and a first wave generator 506 can each be attached to the back surface 522 of the folded first medium 502 without the support element 504 being in contact with the first wave generator 506. In an example, the scoring 606 is to guide a user to create a hole 542 with a longest diameter greater than the longest side or diameter of the first wave generator, such that the support element 504 and the first wave generator 506 are attachable to the back surface 522 of the folded first medium 502 without the support element 504 being in contact with the first wave generator 506.

Returning to FIG. 5, the kit may also include one or more spacer elements that are securable or secured to the back surface 522 of the first medium 502 to position the support element 504 to not touch the center portion 514 of the first medium 502. In the example of FIGS. 5-9, the one or more spacer elements may be a tab or tabs 528 that are scored in the extensions 516 that are connected to center portion 514 of first medium 502. The tabs 528 are to be secured to the back surface 522 of the first medium 502 after folding of the first medium 502 at the extensions 516 according to the scoring 510. The tabs 528 are to be secured to the back surface 522 by a user after folding of the extensions 516 during assembly of the display 518. The secured tabs 528 are to position the support element 504 to not touch the center portion 514 of the first medium 502 and thereby minimize interference with a mechanical wave (e.g., transmitting through the first medium 502 or the support element 504) or an acoustic wave (produced by vibration of the first medium 502 or the support element 504). In an example, wherein a first tab scored in a first extension among the extensions 516, and a second spacer element is a second tab scored in a second extension among 516 extensions, and the first and second tabs are to be secured to the back surface 522 of the first medium 502 after folding of the three extensions 516.

Continuing with FIG. 5, an example kit includes a first wave generator 506 that is attachable or attached to the first medium 502 to be at least partially contained within the cavity 512 that is formed when the first medium is folded. The first wave generator 506 is a system or unit to receive signals from a signal generator and produce mechanical waves within the first medium 502 that will cause the first medium 502 to vibrate and generate audible acoustic waves within a first frequency range in accordance with the signals.

The example kit also includes a second wave generator 508 that is attachable or attached to the support element 504 to be at least partially contained within the cavity 512. The second wave generator 508 is a system or unit to receive signals from a signal generator and produce mechanical waves within the support element 504 that will cause the first medium 502 to vibrate and generate audible acoustic waves within a second frequency range, different from the first frequency range, in accordance with the signals.

Continuing with FIG. 5, the partially-assembled display 524 illustrates the appearance of the foldable first medium 502, support element 504, and the first and second wave generators 506 508 during an example display assembling operation, prior to adhering of a rear surface 540 of the print medium 532 (opposite the print medium's personalization surface 538) to the blank's adhesion surface 520. In an example, the assembly operation includes a step of a user folding foldable first medium 502 at the score lines to form the polygon. In an example, the folding operation includes a step of a user folding a second medium according to score lines to form the support element 504. The assembled display 518 of FIG. 5 illustrates a front view of a completed display after folding of the first medium 502, after the attachment of the first wave generator 506 to the first medium 502, after attachment of the second wave generator 508 to the support element 504, and after the attachment of the support element 504 to the first medium 502.

FIG. 7 is a back, perspective, exploded view of the assembled display 518 of FIG. 5 FIG. 8 is a cross-section view of the assembled rectangular polygon-shaped display 518 of FIG. 5. FIGS. 7 and 8 illustrate that the display 518 includes a first wave generator 506 attached to the back surface 522 of the first medium 502 and at least partially contained within the cavity 512. The first wave generator 506 is a system or unit to receive signals from a signal generator and produce mechanical waves within the first medium 502 that will cause the first medium 502 to vibrate and generate audible acoustic waves within a first frequency range in accordance with the signals. The example kit also includes a second wave generator 508 that is attached to the support element 504 and at least partially contained within the cavity 512. The second wave generator 508 is a system or unit to receive signals from a signal generator and produce mechanical waves within the support element 504 that will cause the first medium 502 to vibrate and generate audible acoustic waves within a second frequency range in accordance with the signals. In the example of FIGS. 7 and 8, the support element 504 includes a hole 542 with a longest diameter greater than the longest side or diameter of the first wave generator 506, such that the support element 504 and the first wave generator 506 are attached to the back surface 522 of the folded first medium 502, via the spacer element tabs 528, with the first wave generator 506 situated in the hole 542. In this manner the support element 504 is not in contact with the first wave generator 506 and interference with mechanical and acoustic caves is minimized.

FIG. 8 illustrates a tablet computer signal generator 806 to supply audio signals to the first wave generator 506 and the second wave generator. In other examples, the signal generator 806 may be a notebook computer, MP3 player or smartphone radio, stereo receiver, or any other audio signal generator.

Various modifications may be made to the disclosed embodiments and implementations without departing from their scope. Therefore, the illustrations and examples herein should be construed in an illustrative, and not a restrictive, sense.

What is claimed is:

1. A kit for making an acoustic display comprising:

a first medium foldable according to scoring to form a display with a cavity, the first medium including a front surface and a back surface opposite the front surface;

a support element attachable or attached to the back surface of the folded first medium, the support element to be positioned at least partially within the cavity;

a first wave generator attachable or attached to the back surface of the folded first medium, the first wave generator to receive signals from a signal generator and produce mechanical waves within the first medium that cause the first medium to vibrate and generate audible acoustic waves within a first frequency range in accordance with the signals;

a second wave generator attachable or attached to the support element, the second wave generator to receive signals from the signal generator and produce mechanical waves within the support element that cause the support element to vibrate and generate audible acoustic waves within a second frequency range, different from the first frequency range, in accordance with the signals; and a first spacer element and a second spacer element securable to the back surface and the support element, to position the support element to not touch the center portion and thereby minimize interference with the mechanical waves or the acoustic waves.

2. The kit of claim 1, wherein the support element has dimensions such that the support element and the first wave generator can each be attached to the back surface of the folded first medium without the support element being in contact with the first wave generator.

3. The kit of claim 1, wherein the scoring is first scoring, and the support element has second scoring to guide a user to cut or shape the support element to dimensions such that the support element and the first wave generator can each be attached to the back surface of the folded first medium without the support element being in contact with the first wave generator.

4. The kit of claim 1, wherein the support element includes a hole with a longest diameter greater than the longest side or diameter of the first wave generator, such that the support element and the first wave generator are attachable to the back surface of the folded first medium without the support element being in contact with the first wave generator.

5. The kit of claim 1, wherein the scoring is first scoring, and the support element includes second scoring to guide a user to create a hole with a longest diameter greater than the longest side or diameter of the first wave generator, such that the support element and the first wave generator are attachable to the back surface of the folded first medium without the support element being in contact with the first wave generator.

6. The kit of claim 1, wherein the first medium includes a center portion, and at least three extensions connected to the center portion, each extension to be folded at least three times according to the scoring to form the cavity.

7. The kit of claim 1, wherein the first medium is to be folded into the form of a polygon.

8. The kit of claim 1, wherein the first medium and the support material are formed from a paper or paperboard material.

9. The kit of claim 1, wherein the first spacer element is a first tab scored in a first extension among the at least three extensions, and the second spacer element is a second tab scored in a second extension among the at least three extensions, and the first and second tabs are to be secured to the back surface after folding of the at least three extensions.

10. The kit of claim 1, further comprising a second medium, the second medium including a personalization surface to receive a user selected-image, and including a rear surface opposite the personalization surface to adhere to the first medium's front surface.

11. The kit of claim 10, wherein the user-selected image is to be printed to the personalization surface using a digital printer chosen from an inkjet printer, piezoelectric printer, electrophotographic printer, liquid electrophotographic printer, and solid ink dye-sublimation printer.

12. The kit of claim 10, wherein the first medium includes:
an adhesive layer established upon the front surface; and
a removable liner positioned on the adhesive layer.

13. An acoustic display, comprising:
a first medium including a front surface and an opposed back surface, at least three sides, and an extension for each of the sides, with each extension folded towards the back surface at least three times according to scoring to form a cavity;
a first wave generator attached to the back surface, the first wave generator to receive signals from a signal generator and produce mechanical waves within the first medium that cause the first medium to vibrate and generate audible acoustic waves within a first frequency range in accordance with the signals;
a second wave generator attached to a support element, the second wave generator to receive signals from the signal generator and produce mechanical waves within the support element that cause the support element to vibrate and generate audible acoustic waves within a second frequency range, different from the first frequency range, in accordance with the signals;
a first tab and a second tab secured to the back surface to position the support element to not touch the center portion, wherein the first tab was formed via scoring in a first extension among the at least three extensions and the second tab was formed via scoring in a second extension among the at least three extensions; and
a first interface to electronically connect the first wave generator to the signal generator; and a second interface to electronically connect the second wave generator to the signal generator.

14. The display of claim 13, further comprising a second medium adhered to the front surface, the medium including a personalization surface upon which a user-selected image has been printed via a digital printer, and including a rear surface opposite the personalization surface adhered to the first medium's back surface.

15. The display of claim 13, wherein the support element and the first wave generator are attached to the back surface of the folded first medium without the support element being in contact with the first wave generator.

16. The display of claim 15, wherein the support element includes a hole, and the first wave generator is situated within the hole.

17. The display of claim 13, wherein the first medium and the support element have a substantially same width along a first axis, and the support element has a shorter length than the length of the first medium along a second axis, and wherein the difference between the length of the first medium and the length of the support element is sufficient for the attachment of the first wave generator to the first medium without being in contact with the support element.

18. A kit for making a personalized display comprising:
a first medium foldable according to first scoring to form a display with a cavity, the first medium including a front surface and a back surface opposite the front surface;
wherein the first medium includes a center portion, and at least three extensions connected to the center portion, each extension to be folded at least three times according to the first scoring to form the cavity;
a support element attachable or attached to the back surface of the folded first medium, the support element to be positioned at least partially within the cavity,
wherein the support element has, or includes second scoring to guide a use to cut or shape the support element to, dimensions such that the support element and a first wave generator can each be attached to the back surface of the folded first medium without the support element being in contact with the first wave generator;
a first spacer element and a second spacer element securable to the back surface to position the support element to not touch the center portion and thereby minimize interference with mechanical waves or acoustic waves
a second medium, the second medium including a personalization surface to receive a user selected-image, and including a rear surface opposite the personalization surface to adhere to the first medium's front surface;
a first wave generator attachable or attached to the back surface of the folded first medium, the first wave generator to receive signals from a signal generator and produce mechanical waves within the first medium that cause the first medium to vibrate and generate audible acoustic waves within a first frequency range in accordance with the signals; and
a second wave generator attachable or attached to the support element, the second wave generator to receive signals from the signal generator and produce mechanical waves within the support element that cause the support element to vibrate and generate audible acoustic waves within a second frequency range, different from the first frequency range, in accordance with the signals.

* * * * *